US007922355B1

(12) United States Patent
Morejon et al.

(10) Patent No.: US 7,922,355 B1
(45) Date of Patent: Apr. 12, 2011

(54) SOLID STATE LIGHTING DEVICE HAVING EFFECTIVE LIGHT MIXING AND CONTROL

(75) Inventors: Israel J. Morejon, Tampa, FL (US); Jinhui Zhai, Oldsmar, FL (US); Thong Bui, Tarpon Springs, FL (US)

(73) Assignee: LEDnovation, Inc., Tampa, FL (US)

( * ) Notice: Subject to any disclaimer, the term of this patent is extended or adjusted under 35 U.S.C. 154(b) by 157 days.

(21) Appl. No.: 12/336,129

(22) Filed: Dec. 16, 2008

(51) Int. Cl.
*F21V 7/00* (2006.01)

(52) U.S. Cl. .... 362/247; 362/545; 362/347; 362/249.02

(58) Field of Classification Search ..... 362/231, 362/247, 249.01, 249.02, 345–347, 545; 340/815.45
See application file for complete search history.

(56) References Cited

U.S. PATENT DOCUMENTS 5,136,483 A * 8/1992 Schoniger et al. ..... 362/545
6,149,283 A * 11/2000 Conway et al. ..... 362/236
7,040,782 B2 * 5/2006 Mayer ..... 362/350
7,178,941 B2 2/2007 Roberge et al.
7,213,940 B1 5/2007 Van De Ven et al.
7,387,405 B2 6/2008 Ducharme et al.
2006/0001384 A1 * 1/2006 Tain et al. ..... 315/246
2006/0250792 A1 * 11/2006 Izardel ..... 362/231
2006/0285325 A1 * 12/2006 Ducharme et al. ..... 362/231
2007/0115656 A1 * 5/2007 Chou et al. ..... 362/228

* cited by examiner

*Primary Examiner* — Julie A Shallenberger
(74) *Attorney, Agent, or Firm* — Ronald E. Smith; Smith & Hopen, P.A.

(57) ABSTRACT

A solid state lighting device includes a light mixing cavity enclosed by a diffusive output window, heat sink walls, and a light-redirection member. A plurality of circumferentially spaced apart light emitters is secured to an interior surface of the heat sink walls. The diffusive output window and light-redirection member are therefore disposed at opposite ends of the light mixing cavity. A semiconductor lighting device driver is disposed external to the light mixing cavity in electrical communication with the light emitters. Light emitted by the plurality of light emitters is reflected from the light-redirection member and from the heat sink walls prior to exiting the light mixing cavity through the diffusive output window.

22 Claims, 3 Drawing Sheets

SOLID STATE LIGHTING DEVICE HAVING EFFECTIVE LIGHT MIXING AND CONTROL

BACKGROUND OF THE INVENTION

1. Field of the Invention

This invention relates generally to solid state lighting devices and related components, systems and methods. More particularly, it relates to methods of light mixing and control from a group of semiconductor light emitters.

2. Description of the Prior Art

Incandescent light bulbs are energy inefficient. About ninety percent (90%) of the electricity consumed is converted into heat instead of light. Fluorescent light bulbs are about ten (10) times more efficient than incandescent light bulbs and solid state semiconductor emitter devices such as light emitting diodes (LEDs) are about twice as efficient as fluorescent light bulbs.

Incandescent light bulbs have a lifetime of about 750-1000 hours. Fluorescent bulbs have lifetimes between 10,000-20,000 hours but they contain mercury and are therefore not an environment friendly light source. They also exhibit less favorable color reproduction. Light emitting diodes have lifetimes between 50,000-75,000 hours, provide very good color reproduction, and are environmentally friendly.

A semiconductor light emitting device using a blue light emitting diode has a main emission peak in blue wavelength ranging from 400 nm to 490 nm. The device includes a luminescent layer containing an inorganic phosphor that absorbs blue light emitted by the blue LED and produces an exciting light having an emission peak in a visible wavelength range from green to yellow (in the range of about 530 nm to 580 nm) with a broad spectrum bandwidth.

Almost all known light emitting semiconductor devices that use blue LEDs and phosphors in combination to obtain color-mixed emission from the LEDs and excitation light from the phosphors use YAG-based or silicate-based luminescent layer as phosphors. Those solid state lighting devices have typically white color temperature of about 5000K-8500K with a low color rending index Ra of about 60-75. Such a white solid state lighting device is not desirable for some applications such as indoor applications that require warm white color at about 2700 k-3500K with a high color rending index Ra above 80.

Another issue faced by conventional solid state lighting devices is the need to further improve luminous efficacy to produce higher energy efficiency with less thermal dissipation so that they can better compete with fluorescent bulbs in high volume and cost effective commercial and residential applications.

To provide a warm white light, warm white semiconductor light emitting solutions use a blue LED with a mixture of YAG-based or silicate-based phosphors for exciting yellow light and nitrides or sulfides phosphors for exciting red light. YAG-based or silicate-based phosphors excite broad-band yellow light, but have a shortage in red light and bluish green light, which limits their color rendering index Ra to less than 70. Adding red phosphor to yellow phosphor can compensate for a shortage of red light, resulting in improved color rendering index of about 75-80. However, red phosphor absorbs blue light with peak wavelength around 460 nm and excites red light with peak wavelength around 620 nm, which causes a significant Stoke-shift issue in photonic energy loss.

A new method for rendering warm white semiconductor light emitting devices was proposed recently (2008) by using a blue LED with YAG-based or silicate-based phosphors for exciting yellow light or blue shifting yellow light and mixing that light with semiconductor emitting red/amber color light. Adding light from a red/amber semiconductor emitter directly to light from a solid state white lighting device solves multi-phosphors self-absorption loss and Stokes shift loss of blue-to-red wavelength conversion. Efforts are ongoing to improve the light mixture from multi-color semiconductor light emitters.

There remains a need, therefore, for multi-color semiconductor light emitters having improved light mixtures.

More specifically, there is a need for an effective color mixing solution for multi-spectrum semiconductor emitters in a warm white solid state lighting device.

However, in view of the prior art taken as a whole at the time the present invention was made, it was not obvious to those of ordinary skill how the identified need could be fulfilled.

SUMMARY OF THE INVENTION

The long-standing but heretofore unfulfilled need for an apparatus and method for multi-color semiconductor light emitters having improved light mixtures is now met by a new, useful, and non-obvious invention.

The novel solid state lighting device includes a light mixing cavity that is enclosed by a diffusive output window, heat sink walls, and a light-redirection member.

The diffusive output window is referred to herein as a diffusive output window to better indicate its function.

The heat sink walls are highly reflective and have a first end mounted about a peripheral edge of the light-redirection member and a second end mounted about a peripheral edge of the diffusive output window.

The diffusive output window and light-redirection member are disposed in substantially parallel relation to one another.

The light-redirection member is herein referred to as a light-redirection member to better indicate its function.

A semiconductor lighting device driver is disposed external to the light mixing cavity in closely spaced, substantially parallel relation to the light-redirection member.

A plurality of circumferentially spaced apart multi-spectrum semiconductor light emitters is secured to an interior surface of the heat sink walls. Each of the light emitters is in electrical communication with a source of electrical power.

Light emitted by the plurality of light emitters is mixed within the light mixing cavity prior to exiting the light mixing cavity through the diffusive output window.

In a first embodiment, the diffusive output window is flat and has a round, disc-shaped configuration. The light-redirection member has a central part shaped like a dome that is circumscribed by a flat flange. The heat sink walls include a first annular sidewall disposed normal to the diffusive output window and the light-redirection member. The first annular sidewall is mounted to the periphery of the light-redirection member. The heat sink walls further include a second annular sidewall formed integrally with the first annular sidewall. The second annular sidewall is flared radially outwardly with respect to the first annular sidewall and has an annular free end mounted about the periphery of the diffusive output window.

The light emitters are circumferentially and equidistantly spaced apart from one another about a periphery of the first annular sidewall, facing the center or longitudinal axis of the solid state device.

In a second embodiment, the light-redirection member has a convex shape.

In a third embodiment, the diffusive output window has a hemispherical configuration and the light-redirection member has a central dome and a flat flange circumscribing the dome as in the first embodiment.

In a fourth embodiment, the diffusive output window has a hemispherical configuration as in the third embodiment, and the light-redirection member has a central dome and a flat flange circumscribing the dome as in the first and third embodiments. A light emitter is mounted atop the light-redirection member at the apex of the central dome. In a preferred embodiment, an opening is formed in said dome at said apex and at least one light emitter is mounted in the opening. A thermally-conductive substrate is disposed in heat transfer relation to the at least one light emitter that is mounted in said opening atop said light-redirection member at the apex of the central dome. Specifically, the thermally-conductive substrate is mounted on an underside of said central dome.

In a fifth embodiment, the diffusive output window has a hemispherical configuration as in the third and fourth embodiments, the highly light-reflective heat sink walls have a frusto-conical or parabolic configuration, and the light-redirection member has a flat, disc-shaped configuration. A thermally-conductive substrate is mounted atop the flat light-redirection member, centrally thereof, inside the mixing cavity. The thermally-conductive substrate has sidewalls disposed normal to the light-redirection member and a first plurality of light emitters is secured to the sidewalls so that light rays emitted by the light emitters of the first plurality of light emitters travel radially outwardly from the thermally-conductive substrate to the light-reflective heat sink walls and are mixed within the mixing cavity by reflecting from the light-redirection member and the heat sink walls before exiting the mixing cavity through the diffusive output window.

The thermally-conductive substrate has a flat top wall disposed in parallel relation to the light-redirection member and a second plurality of light emitters is secured to the flat top wall, centrally thereof, so that light rays emitted by the light emitters of the second plurality of light emitters travel radially outwardly toward the frusto-conical heat sink walls and forwardly toward the diffusive output window and are mixed within the mixing cavity by reflecting from the light-redirection member and the frusto-conical heat sink walls before exiting the mixing cavity through the diffusive output window.

The fifth embodiment also includes a light distribution shaping member mounted atop the light emitters of the second plurality of light emitters.

Generally speaking, the novel method for generating a warm white solid state light includes multi-spectrum semiconductor light emitters to achieve broad spectrum distribution for a high color rendering index and to avoid multi phosphors mutual absorption and Stoke-shift loss of red phosphor for a high luminous efficacy.

The output light distribution is controlled by re-configuring the shape and size of the light-redirection member and the diffusing angle of the diffusive output window.

The plurality of semiconductor light emitters includes at least one semiconductor blue emitter with a yellow phosphor layer on top of the semiconductor emitter to excite a yellow light and at least one semiconductor red or reddish orange emitter to compensate for the shortage of red wavelength of the excited yellow light. The reflective dome may be a diffusive or specular light-redirection member.

An important object of the present invention is to disclose an effective light mixing system having an effective color mixing solution for multi-spectrum semiconductor lighting emitters.

A closely related object is to disclose a method for multi-spectrum semiconductor emitters having a high luminous efficacy.

Another object is to provide a high color rendering solid state white light device that includes a specifically designed light-redirection member to re-direct light from a first plurality of side mounted semiconductor lighting emitters into a light mixing cavity in combination with a second plurality of forward-transferred lights to provide a multi-spectrum fully mixed light that is exported from a diffusive output window.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1A:
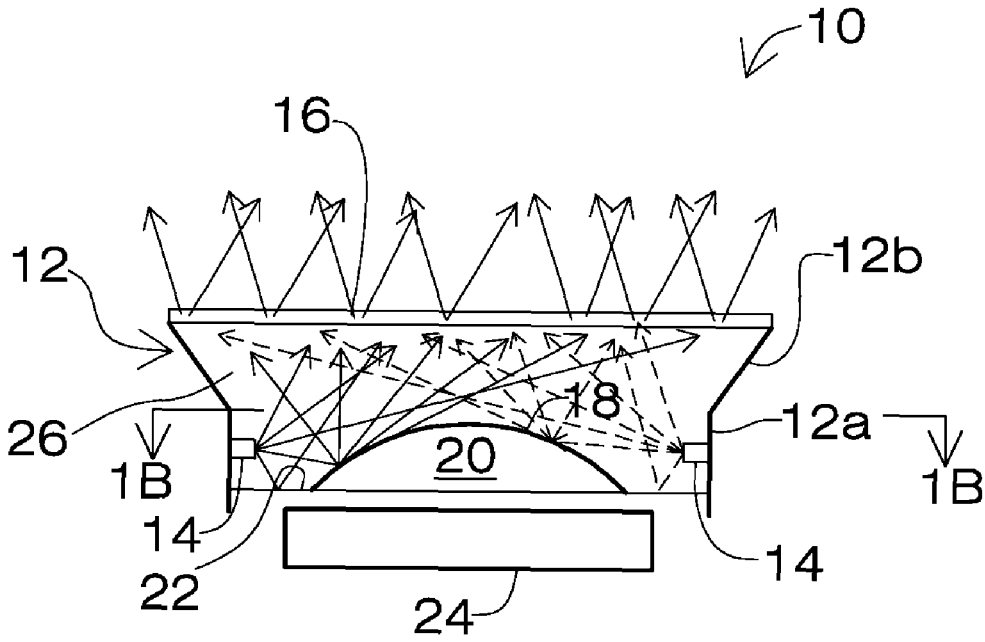
FIG. 1A is a side elevational, diagrammatic view of the first embodiment.

Referring now to FIG. 1A, it will there be seen that an illustrative embodiment of the invention is denoted as a whole by the reference numeral 10.

Solid state lighting device 10 includes a solid state device heat sink body 12 having an upstanding annular base wall 12*a* formed integrally with an annular wall 12*b* that is flared radially outwardly with respect to a longitudinal axis of symmetry of device 10. The interior surfaces of walls 12*a* and 12*b* are highly light-reflective.

Figure 1B:
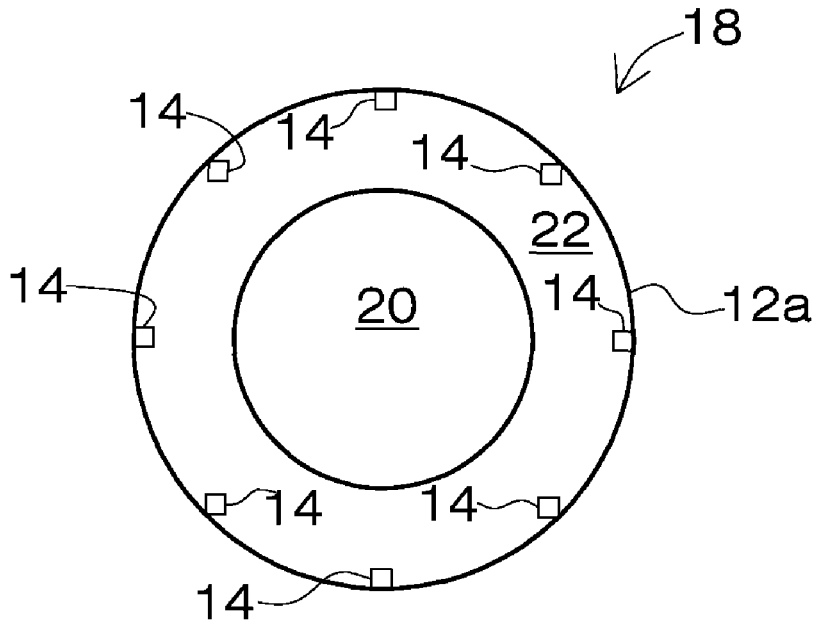
FIG. 1B is a sectional view, taken along line 1B-1B in FIG. 1A.

A plurality of semiconductor lighting emitters, collectively denoted 14, is directly mounted to the interior side of annular base wall 12*a* in equidistantly spaced, circumferential relation to one another as best understood in connection with FIG. 1B. Lighting emitters 14 therefore face a center or longitudinal axis of device 10. However, the invention is not limited to such circumferential and equidistantly spaced arrangement. Any other interval may be provided between contiguous light emitters; accordingly, it is understood that the light emitters are intervallically arranged.

Diffusive output window 16 surmounts the uppermost end of flared annular wall 12*b*. Diffusive output window 16 exports mixed multi-spectrum light.

Light-redirecting member 18 in this first embodiment includes dome 20 and an annular flat flange 22 that circumscribes the dome. Dome 20 may be a specular light-redirection member or a diffusive light-redirection member. The shape and size of dome 20 configures the output light distribution.

Flat flange 22 is a specular light-redirection member and fits snugly into the space bounded by annular base wall 12*a*. The outer peripheral edge of flat flange 20 is fixedly secured to the interior surface of annular base wall 12*a*. Lighting emitters 14 are positioned about mid-length of annular base wall 12*a* and flat flange 20 is therefore positioned below said lighting emitters 16.

Light mixing cavity 26 is defined as the space enclosed by solid state device heat sink body 12, diffusive output window 16, and light-redirecting member 18.

Semiconductor lighting device driver 24 is disposed in exterior relation to light mixing cavity 26. An LED driver such as device 24 is a self-contained power supply having outputs matched to the electrical characteristics of an LED or an array of LEDs.

Semiconductor lighting emitters 14 are electrically interconnected to one another by at least one power string line, not depicted, and semiconductor lighting device driver 24 is in electrical communication with light emitters 14. When a current is supplied to the power string line, multi-spectrum light rays from the semiconductor lighting emitters 14 are fully mixed before being exported through diffusive output window 16. The output light distribution can be controlled by re-configuring the shape and size of reflective dome 20 and the diffusing angle of diffusive output window 16.

Dome 20 re-directs light rays emitted by light emitters 14 and at least some of the re-directed light is re-directed forwardly. As depicted, the forward direction is the upward direction, i.e., toward diffusive output window 16.

In FIG. 1, light rays from a first light emitter 14 are drawn in solid lines and light rays from a second light emitter 14 that is diametrically opposed to said first light emitter are drawn in broken lines to indicate that different light emitters may emit light at differing spectrums. Note how some light rays may miss dome 20 entirely and not even reflect from a wall 12 before exiting light mixing cavity 26 through diffusing output window 16. However, even such a light ray will travel across said light mixing cavity and become mixed with many other rays before exiting. Other light rays may miss the dome and reflect only from the highly reflective surfaces of walls 12 before exiting light mixing cavity 26 through diffusive output window 16. Other light rays may be reflected by the dome at slight angles or at angles greater than ninety degrees (90°). No light ray can exit light mixing cavity without mixing with other light rays.

The plurality of semiconductor lighting emitters 14 includes at least one semiconductor blue emitter with a yellow phosphor layer on the top of the semiconductor emitter to excite a yellow light and at least one semiconductor red or reddish orange emitter to compensate for the shortage of red wavelength of the excited yellow light.

Light-redirection member 18 cooperates with the interior surfaces of heat sink body 12 to recycle light in light mixing cavity 26. Some light rays from the semiconductor emitters 14 propagate forwardly inside light mixing cavity 26 towards diffusive output window 16 and some light rays from said semiconductor emitters 14 are redirected by light-redirection member 18 and mixed with forward propagation light from the other semiconductor emitters 14. Backscatter light from diffusive output window 16 is recycled by light-redirection member 18 into a forward-transferred light in light mixing cavity 26 and exported from diffusive output window 16. Center reflective dome 20 may be a diffusive light-redirection member to redirect the light into a random angle forward-transferred light for evenly mixing light.

Figure 2:
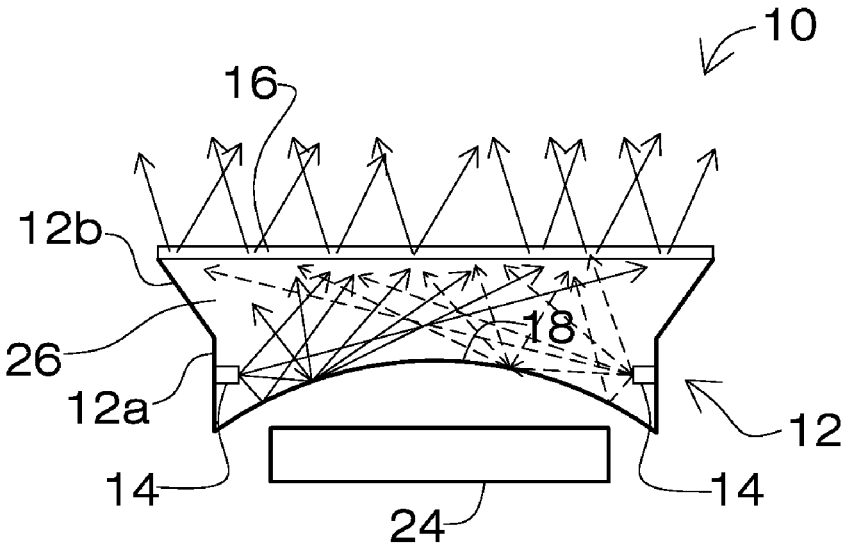
FIG. 2 is a side elevational, diagrammatic view of a second embodiment.

FIG. 2 depicts a second embodiment where light-redirection member 18 is dome-shaped. As in the first embodiment, it completely closes the bottom of light mixing cavity 26. Dome-shaped light-redirection member 18 may be a specular light-redirection member or a diffusive light-redirection member.

As in the first embodiment, the light rays emitted by the depicted light emitters 14 are drawn in solid lines for a first light emitter and in broken lines for a second light emitter, indicating that the light emitters may emit light at different spectrums.

Figure 3:
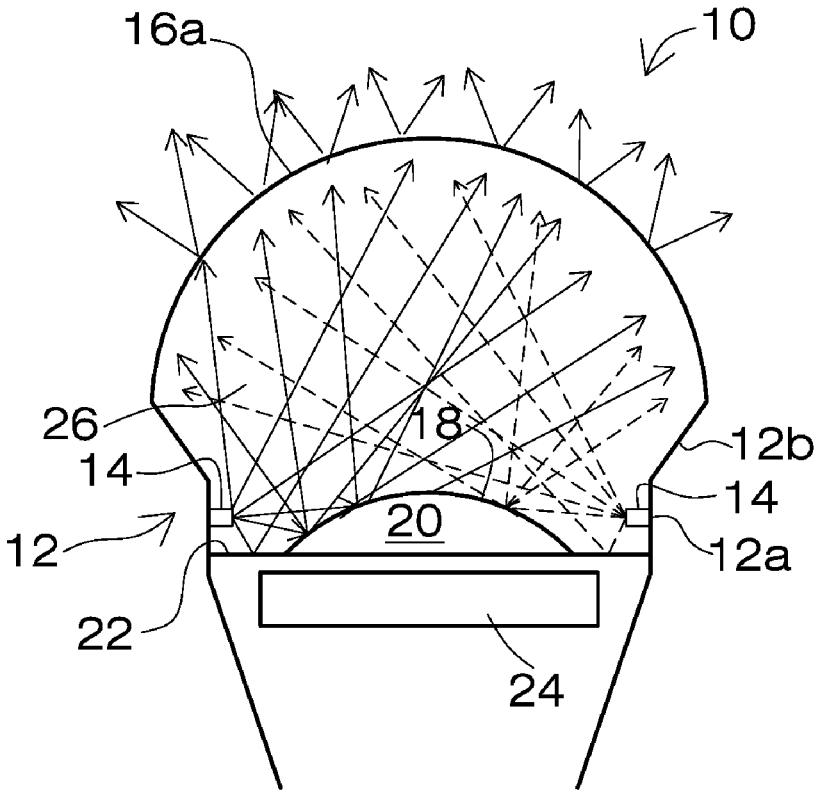
FIG. 3 is a side elevational, diagrammatic view of a third embodiment.

The embodiment of FIG. 3 differs from the first embodiment of FIGS. 1A and 1B only to the extent that diffusive output window 16*a* is hemispherical in configuration or dome-shaped instead of flat like diffusive output window 16 of the first embodiment. This greatly increases the volume of light mixing cavity 26 and thus provides greater color mixing.

In an unillustrated embodiment, solid state lighting device 10 may include a light-redirection member 18 including a wavelength conversion component. The wavelength conversion component is deposited on top of light-redirection member 18. The wavelength conversion component absorbs backscattered short wavelength light from diffusive output window 16 and the emission light from the semiconductor emitting components 14, and converts into a desired visible light to adjust the mixing light chromaticity.

Figure 4:
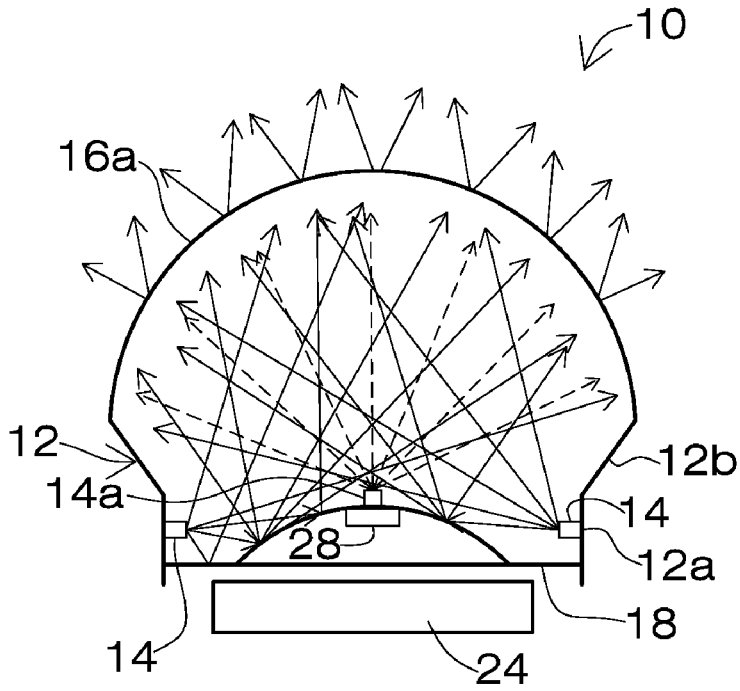
FIG. 4 is a side elevational, diagrammatic view of a fourth embodiment.

The fourth depicted embodiment of solid state lighting device 10 includes two groups of semiconductor lighting emitters 14 and 14*a* as depicted in FIG. 4.

The first plurality of semiconductor lighting emitters 14 is mounted just as in the first, second, and third embodiments, and light-redirection member 18 is the same as light-redirection member 18 in FIGS. 1A and 1B and performs the same function as in the first embodiment.

A second plurality of semiconductor lighting emitters is denoted 14*a* and is mounted on thermally-conductive substrate 28 at the center of dome 20; an opening is formed in the dome to facilitate the mounting. Only one (1) central light emitter 14*a* is depicted to simplify the drawing. The re-directed first group 14 spectrum light and the emission of second group 14*a* spectrum light is mixed in light mixing cavity 26 and exported from diffusive output window 16 of solid state lighting device 10.

In FIG. 4, solid lines indicate light rays emitted by peripherally-mounted light emitters 14 and broken lines indicate light rays emitted from the central light emitters 14*a*.

Each emitter of the first plurality or peripherally mounted semiconductor lighting emitters 14 may generate the same spectrum or spectrums of light. Each emitter of the second plurality or centrally mounted lighting emitters 14*a* may also generate the same spectrum or spectrums but the spectrum or spectrums of the first plurality of lighting emitters is preferably different from the spectrum or spectrums emitted by the second plurality of lighting emitters as indicated by said solid and broken lines. A shaping member may be deposited on top of the second plurality of semiconductor lighting emitters 14*a* to change the light distribution to uniformly mix with the light emitted by the first plurality of lighting emitters 14.

Figure 5:
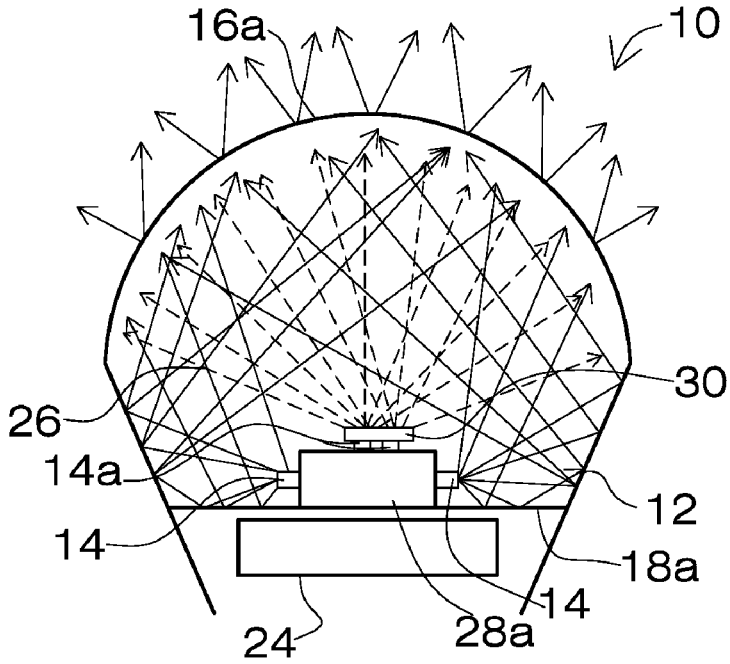
FIG. 5 is a side elevational, diagrammatic view of a fifth embodiment.

In the embodiment of FIG. 5, solid state lighting device 10 also includes two groups of semiconductor lighting emitters 14 and 14*a*.

The first plurality of semiconductor lighting emitters 14 is directly mounted to the sidewalls of centrally-mounted thermal conductive member 28 as depicted. Thermal conductive member 28 is thermally connected to solid state lighting heat sink body 12.

The second plurality of semiconductor lighting emitters 14*a* is directly mounted to the top wall of said centrally-mounted thermal conductive member 28 as depicted.

The reflective interior surface of frusto-conical or parabolic solid state lighting device heat sink 12 redirects light from the first plurality of lighting emitters 14 into a forward light and mixes with light from the second plurality of lighting emitters 14*a* and exports the mixed light through diffusive output window 16*a*. Parabolic light-redirection member 12 may be a diffusive light-redirection member.

Light-redirection member 18 is flat in this fifth embodiment.

As in the fourth embodiment, each emitter of the first plurality of semiconductor lighting emitters 14 may generate the same spectrum or spectrums of light as the other emitters of said first plurality. Each emitter of the second plurality of lighting emitters 14*a* may also generate the same spectrum or spectrums of light as the other emitters of the second plurality. However, the spectrum or spectrums emitted from the first and second pluralities of lighting emitters is different from one another.

Shaping member 30 may be positioned in overlying relation to semiconductor lighting emitters 14*a* of the second plurality of light emitters to change the light distribution to uniformly mix with the first plurality 14 of light emitters.

The specific structures depicted for the various embodiments are not restricted to those embodiments. Multiple combinations of such structures can be made without departing from the scope of the invention. For example, the convex light-redirecting member 18 of the second embodiment, depicted in FIG. 2, could also be used in the embodiments of FIGS. 3-5. The frusto-conical heat sink walls of the FIG. 5 embodiment may supplant the straight and flared-out heat sink walls of the other embodiments and vice versa. These and other combinations are not depicted to conserve paper and related resources but those of ordinary skill in the art will readily understand that the scope of the invention is not limited to the examples disclosed herein.

The first broad aspect of the invention is therefore understood to include a light mixing cavity where a plurality of light emitters are mounted about a periphery thereof and are adapted to emit light rays toward the center of the light mixing cavity where a light-redirecting member is positioned. The combination of light rays traveling radially inwardly from multiple circumferentially spaced sources and light rays being reflected radially outwardly and forwardly by a light redirecting member in the center of the light mixing cavity is highly novel.

In the second broad aspect of the invention, a second plurality of light emitters is centrally positioned within the light mixing cavity and the light emitted thereby mixes with light emitted by the first plurality of peripherally-mounted light emitters, thereby even further enhancing the light mixing process.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A solid state lighting device, comprising:

a light mixing cavity having a center axis;

said light mixing cavity enclosed by reflective surfaces and a diffusive output window;

a plurality of light emitters positioned within said light mixing cavity, radially outwardly of said center axis;

said plurality of light emitters adapted to emit multi-spectrum light;

said reflective surfaces including an annular sidewall that forms a heat sink body of said solid state lighting device;

a light-redirection member positioned within said cavity, said light-redirection member being centered on said center axis;

said plurality of light emitters positioned on an interior surface of said annular sidewall, said annular sidewall disposed normal to said diffusive output window and said light-redirection member;

said light-redirection member having a central dome and a flat flange circumscribing said dome;

each light emitter of said plurality of light emitters arranged to emit light rays radially inwardly toward said light-redirection member;

a semiconductor lighting device driver disposed external to said light mixing cavity in electrical communication with each light emitter of said plurality of light emitters;

whereby light emitted by said plurality of light emitters is reflected from said light-redirection member and from said reflective surfaces of said light mixing cavity prior to exiting said light mixing cavity through said diffusive output window so that light colors are thoroughly mixed and whereby light rays from said light emitters of said plurality of light emitters reflects from said central dome, said flat flange, and said heat sink walls and thereby become thoroughly mixed before escaping from said light mixing cavity through said diffusive output window.

2. The solid state lighting device of claim 1, further comprising:

said multi-spectrum light including at least one mixture of blue and excited yellow light and at least one reddish orange light.

3. The solid state lighting device of claim 1, further comprising:

said diffusive output window being flat and having a round, disc-shaped configuration.

4. The solid state lighting device of claim 1, further comprising:

said diffusive output window having a hemispherical configuration.

5. The solid state lighting device of claim 1, further comprising:

said light emitters of said plurality of light emitters being circumferentially spaced apart from one another about a periphery of said annular sidewall.

6. The solid state lighting device of claim 1, further comprising:

said light emitters of said plurality of light emitters being multi-spectrums intervallically and equidistantly spaced apart from one another about a periphery of said annular sidewall.

7. The solid state lighting device of claim 1, further comprising:

said central dome being a diffusive reflector.

8. The solid state lighting device of claim 1, further comprising:

said light-redirection member having a convex shape.

9. A solid state lighting device, comprising:

a light mixing cavity having a center axis;

said light mixing cavity enclosed by reflective surfaces and a diffusive output window;

a plurality of peripheral light emitters positioned within said light mixing cavity, radially outwardly of said center axis;

a light-redirection member positioned within said cavity, said light-redirection member being centered on said center axis;

each light emitter of said plurality of peripheral light emitters arranged to emit light rays radially inwardly toward said light-redirection member;

at least one central light emitter mounted on said light-redirection member, said at least one central light emitter adapted to emit light rays in a radially outwardly direction so that said light rays traveling radially outwardly from said central light emitter mix with light rays traveling radially inwardly from said plurality of peripheral light emitters;

said peripheral light emitters adapted to emit light rays of a common spectrum;

said at least one central light emitter adapted to emit light rays in a spectrum different from said common spectrum; and a semiconductor lighting device driver disposed external to said light mixing cavity in electrical communication with each light emitter of said plurality of light emitters;

whereby light rays emitted radially inwardly by said plurality of peripheral light emitters and light rays emitted radially outwardly by said at least one central light emitter mix with one another and are reflected from said light-redirection member and from said reflective surfaces of said light mixing cavity so that light rays of said common spectrum and light rays of said different spectrum are thoroughly mixed together prior to exiting said light mixing cavity through said diffusive output window.

10. The solid state lighting device of claim 9, further comprising:

said peripheral light emitters adapted to emit a mixture of blue and excited yellow light, and said at least one central light emitter adapted to emit reddish orange light.

11. The solid state lighting device of claim 9, further comprising:

said diffusive output window being flat and having a round, disc-shaped configuration.

12. The solid state lighting device of claim 9, further comprising:

said diffusive output window having a hemispherical configuration.

13. The solid state lighting device of claim 9, further comprising:

said reflective surfaces of said light mixing cavity including an annular sidewall that forms a heat sink body of said solid state lighting device;

said plurality of light emitters positioned on an interior surface of said annular sidewall, said annular sidewall disposed normal to said diffusive output window and said light-redirection member.

14. The solid state lighting device of claim 13, further comprising:

said light emitters of said plurality of light emitters being circumferentially spaced apart from one another about a periphery of said annular sidewall.

15. The solid state lighting device of claim 14, further comprising:

said light emitters of said plurality of light emitters being circumferentially and equidistantly spaced apart from one another about a periphery of said annular sidewall.

16. The solid state lighting device of claim 9, further comprising:

said light-redirection member having a central dome and a flat flange circumscribing said dome;

whereby light rays from said light emitters of said plurality of light emitters reflects from said central dome, said flat flange, and said reflective surfaces and thereby become thoroughly mixed before escaping from said light mixing cavity through said diffusive output window.

17. The solid state lighting device of claim 9, further comprising:

said light-redirection member having a convex shape.

18. The solid state lighting device of claim 9, further comprising:

said light-redirection member having a central dome and a flat flange circumscribing said central dome; and said at least one light emitter mounted atop said light-redirection member being mounted to said central dome at the apex thereof.

19. The solid state lighting device of claim 18, further comprising:

a thermally-conductive substrate disposed in heat transfer relation to said light emitter that is mounted atop said light-redirection member at said apex of said central dome;

said thermally-conductive substrate being mounted on an underside of said central dome.

20. The solid state lighting device of claim 9, further comprising:

said reflective surfaces having a frusto-conical configuration;

said light-redirection member having a flat, disc-shaped configuration;

a thermally-conductive substrate mounted atop said flat light-redirection member, centrally thereof, inside said mixing cavity;

said thermally-conductive substrate having sidewalls disposed normal to said light-redirection member;

a first plurality of light emitters secured to said sidewalls so that light rays emitted by said light emitters of said first plurality of light emitters are mixed within said mixing cavity by reflecting from said light-redirection member and said frusto-conical reflective surfaces before exiting said mixing cavity through said diffusive output window.

21. The solid state lighting device of claim 20, further comprising:

said thermally-conductive substrate having a flat top wall disposed in parallel relation to said light-redirection member;

a second plurality of light emitters secured to said flat top wall so that light rays emitted by said light emitters of said second plurality of light emitters are mixed within said mixing cavity by reflecting from said light-redirection member and said frusto-conical reflective surfaces before exiting said mixing cavity through said diffusive output window.

22. The solid state lighting device of claim 21, further comprising:

a light distribution shaping member mounted atop said light emitters of said second plurality of light emitters.

* * * * *